US005933169A

United States Patent [19]

Sugahara

[11] Patent Number: 5,933,169

[45] **Date of Patent: *Aug. 3, 1999**

[54] TWO ACTUATOR SHEAR MODE TYPE INK JET PRINT HEAD WITH BRIDGING ELECTRODE

[75] Inventor: Hiroto Sugahara, Aichi-ken, Japan

[73] Assignee: Brother Kogyo Kabushiki Kaisha, Nagoya, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/628,079

[22] Filed: Apr. 8, 1996

[30] Foreign Application Priority Data

Apr. 6, 1995 [JP] Japan ..... 7-081057
Apr. 7, 1995 [JP] Japan ..... 7-082209

[51] Int. Cl.[6] ..... B41J 2/045

[52] U.S. Cl. ..... 347/71; 347/69

[58] Field of Search ..... 347/68, 69, 71; 361/771, 777, 779; 174/257

[56] References Cited

U.S. PATENT DOCUMENTS

| | | | |
|---|---|---|---|
| 4,284,921 | 8/1981 | Lemonon et al. | 310/328 |
| 4,339,763 | 7/1982 | Kyser et al. . | |
| 4,879,568 | 11/1989 | Bartky et al. . | |
| 4,887,100 | 12/1989 | Michaelis et al. . | |
| 5,016,028 | 5/1991 | Temple . | |
| 5,159,349 | 10/1992 | Endo . | |
| 5,481,285 | 1/1996 | Pies et al. | 347/45 |

FOREIGN PATENT DOCUMENTS

| | | | |
|---|---|---|---|
| 95911 | 12/1983 | European Pat. Off. | 347/69 |
| 612622 | 8/1994 | European Pat. Off. | 347/69 |
| 53-12138 | 4/1978 | Japan . | |
| B2-61-59914 | 12/1986 | Japan . | |
| A-63-247051 | 10/1988 | Japan . | |
| A-63-252750 | 10/1988 | Japan . | |
| A-2-150355 | 6/1990 | Japan . | |
| 5-38808 | 2/1993 | Japan | 347/69 |
| A-5-92561 | 4/1993 | Japan . | |
| 6-155738 | 6/1994 | Japan | 347/69 |

OTHER PUBLICATIONS

IBM Technical Disclosure Bulletin, "Through–Hole Plating" D.A. Radovsky & B.J. Ronkese, vol. 3, No. 5, Oct. 1960.

IBM Technical Disclosure Bulletin, "Interconnection for Stacked Substrates Having Integrated Chip", N.C. Mescia & K.J. Puttlitz, vol. 16, No. 1 Jun. 1973.

*Primary Examiner*—Benjamin R. Fuller
*Assistant Examiner*—C. Dickens
*Attorney, Agent, or Firm*—Oliff & Berridge, PLC

[57] ABSTRACT

An ink jet print head is constructed from first and second actuator plates 102 and 103. Each side wall 111 and a corresponding side wall 116 are connected to each other, at their top surfaces, to form a single side wall 118. An ink chamber 112 filled with ink 181 is formed between two adjacent side walls 118. The side walls 111 are formed with electrodes 113, and the side walls 116 are formed with electrodes 114. Electrodes 213 are provided over both the electrodes 113 and 114 to provide reliable electrical connection therebetween.

14 Claims, 15 Drawing Sheets

TWO ACTUATOR SHEAR MODE TYPE INK JET PRINT HEAD WITH BRIDGING ELECTRODE

BACKGROUND OF THE INVENTION

1. Field of the Invention

The present invention relates to an ink jet print head and a method of producing the same. More particularly, the present invention relates to a shear mode type ink jet print head and a method of producing the same.

2. Description of the Related Art

Recently, drop-on-demand type ink jet print heads have been greatly developed. The drop-on-demand type print head ejects only the ink droplets to be used for printing.

Representative examples of the drop-on-demand print heads include a Kyser type disclosed in U.S. Pat. No. 4,339,763 and a thermal jet type disclosed in U.S. Pat. No. 5,159,349. Each type of these print heads, however, involves problems. The Kyser type is difficult to be modified into a smaller size. In the thermal jet type, inks are required to have high thermal resistance properties.

A shear mode type of ink jet print head has therefore been proposed to solve both of these problems. This shear mode type print head is disclosed in U.S. Pat. Nos. 4,879,568, 4,887,100, and 5,016,028 and in Japanese Patent Application Publication Kokai No.5-92561.

A shear mode type print head is conceivable as shown in FIGS. 1 to 6. Directional terms such as "upper," "lower," "front," "rear," "right," and "left" used in the following explanations refer to the ink jet print head when in the posture shown in FIG. 3.

As shown in FIG. 3, the ink jet print head 1 is constructed from an actuator plate 2, a cover plate 3, a nozzle plate 31, and a driving substrate 41. The actuator plate 2 is formed from a piezoelectric material, such as a lead zirconium titanate (PZT) ceramic material, having ferroelectric properties. As shown in FIG. 1, the actuator plate 2 is polarized in an upward direction indicated by an arrow 5, and has a plurality of grooves 15 and side walls 11 separating the grooves 15. The cover plate 3 is formed from a ceramic material or a resin material. The actuator plate 2 and the cover plate 3 are bonded together by an adhesive layer 4 made from, for example, an epoxy adhesive. This forms the grooves 15 into a plurality of ink chambers 12. Thus formed ink chambers 12 are arranged with a certain interval in a horizontal direction A normal to the polarizing direction 5.

As apparent from FIG. 3, each of the thus produced ink chambers 12 extends along another horizontal direction B which is perpendicular to both the directions A and 5. Thus, each ink chamber 12 has an elongated shape. Each ink chamber 12 has a rectangular cross-section as shown in FIG. 1. The side walls 11 extend over the entire length of the ink chambers 12. A pair of electrodes 13, for applying a driving voltage through each side wall 11, are formed on both side surfaces of the side wall 11 from the top of the side wall 11 near the adhesive layer 4 to the middle of the side wall 11. Ink 81 is introduced to the ink chambers 12 from an ink supply port 21 via a manifold 22.

With the above-described structure, the ink jet print head 1 operates as described below. As shown in FIG. 2, when an ink chamber 12*b*, for example, is selected to eject an ink droplet according to desired print data, a positive driving voltage is applied to the electrodes 13*c* and 13*d* while the electrodes 13*b* and 13*e* are grounded. As a result, an electric field is generated in a direction 14*a* through the side wall 11*a*, and an electric field is generated in a direction 14*b* through the side wall 11*b*. The directions 14*a* and 14*b* of the electric fields are substantially normal to the polarization direction 5. This makes the side walls 11*a* and 11*b* deform inwardly due to a piezoelectric thickness shear effect. The deformation of the side walls 11*a* and 11*b* reduces the volume in the ink chamber 12*b*, thereby increasing the pressure of the ink 81 in the ink chamber 12*b*. This generates a pressure wave, whereby a portion of the ink 81 is ejected in the form of an ink droplet from a nozzle 32 connected with the ink chamber 12*b*.

When the application of the driving voltage is stopped, the side walls 11*a* and 11*b* return to their original positions shown in FIG. 1. This reduces the pressure of the ink 81 in the ink chamber 12*b*, whereby an additional ink 81 is supplied into the ink chamber 12*b* from the ink supply port 21 via the manifold 22.

In the above description, the driving voltage is applied in a direction so that the volume of the ink chamber 12*b* decreases, whereby an ink droplet is ejected from the ink chamber 12*b*. Alternatively, the driving voltage may be applied in an opposite direction so that the volume of the ink chamber 12*b* first increases and so that ink is additionally supplied to the ink chamber 12*b*. When the application of the driving voltage is stopped, the side walls 11*a* and 11*b* return to their original positions shown in FIG. 1, thereby ejecting an ink droplet.

According to the above-described driving operation, two adjacent ink chambers cannot be driven to eject ink droplets simultaneously. Accordingly, the plurality of ink chambers 12 in the actuator 2 are divided into at least two groups, and the two groups are driven alternately. For example, the ink chambers 12 are divided into two groups so that ink chambers 12*b* and 12*d* are in one group while an ink chamber 12*c* is in the other group. The two groups are alternately driven.

Next, the method of manufacturing the print head 1 will be described with reference to FIG. 3.

An actuator plate 2 which has been polarized in the direction 5 is first subjected to a grinding process using a thin disk-shaped diamond blade. This grinding process produces the parallel grooves 15 each being sandwiched between two adjacent side walls 11. The grooves 15 extend from a front end surface 16 in a direction toward the rear end surface 17. The grooves 15 have the same depth over nearly the whole actuator plate 2. However, at a certain position near to the rear end surface 17, the grooves 15 are made to gradually become shallower as they approach the rear end surface 17, thus forming parallel shallow grooves 18 near the rear end surface 17.

Electrodes 13 and 19 are then formed on the inner surfaces of both the grooves 15 and the shallow grooves 18 through a process such as a vacuum evaporation and a sputtering. This process is designed so that the floor and the lower half of the inner side surface of the grooves 15 will not be formed with the electrodes 13. For example, when a vacuum evaporation process is employed, the actuator plate 2 is tilted at an angle in relation to a direction in which metal vapor travels from a deposition source. The tilt angle is selected so that the floor and the lower half of the inner side surfaces of the grooves 15 are in a shadow with respect to the metal vapor travelling direction.

Then, electrodes are removed from the top surface portions of the side walls 11 through a process such as lapping. As a result, electrodes on both sides of the side walls 11 are separated from each other. Electrodes 13 thus remain only on the upper half of the inner side surfaces on the grooves 15. Electrodes 19 remain on the entire inner side surfaces and bottom surface of the shallow grooves 18. An electrode 19 thus formed on each groove 18 is for electrically connecting electrodes 13 formed on both inner side surfaces of a corresponding groove 15.

Then, a cover plate 3 made from a ceramic material or a resin material is subjected to a grinding or cutting process so that the ink supply port 21 and the manifold 22 are formed in the cover plate 3.

Next, the side of the actuator plate 2 with the grooves 15 formed and the side of the cover plate 3 with the manifold 22 formed are bonded at the surfaces by an adhesive layer 4 made from an epoxy adhesive or the like. As a result, each of the grooves 15 forms an ink chamber 12 with a shape as shown in FIG. 1. Then, a nozzle plate 31 formed with nozzles 32 in positions corresponding to the positions of the ink chambers 12 is bonded to the front end surface 16 of the actuator plate 2 and to a front end of the cover plate 3.

Then, the driving substrate 41 is bonded to the side opposite the grooved side of the actuator plate 2 by an epoxy adhesive or the like. The substrate 41 is provided with conductor layer patterns 42 in positions corresponding to the positions of the shallow grooves 18. The electrode 19 on the bottom surface of each shallow groove 18 and the corresponding conductor layer pattern 42 are then connected by a conductor wire 43 through a wire-bonding process. Because the diameter of the conductor wire 43 is extremely small with little mechanical strength, an epoxy resin or the like is used for forming (potting) a protective film (not shown) to prevent contact and breaking of adjacent conductor wires 43 and to prevent corrosion due to moisture or dust particles in the air. The protective film is thermally set.

The above-described ink jet print head 1 is provided with a driving control unit. The driving control unit is constructed from a LSI chip 51 as shown in FIG. 4. Each of the conductor layer patterns 42 formed on the driving substrate 41 is connected to the LSI chip 51. A clock line 52, a data line 53, a voltage line 54, and a ground line 55 are also connected to the LSI chip 51. The LSI chip 51 determines which nozzle 32 to eject the ink droplet from according to data appearing in the data line 53 based on clock pulses successively supplied from the clock line 52. The LSI chip 51 applies a voltage V of the voltage line 54 to a conductor layer pattern 42 electrically connected to the electrode 13 in the ink chamber 12 that is determined to eject the ink. Also, the LSI chip 51 applies the zero voltage of the ground line 55 to conductor layer patterns 42 electrically connected to the electrodes 13 in the other ink chambers 12 that are not to eject the ink.

The above-described print head 1 is mounted in a printer as shown in FIG. 5.

The ink jet print head 1 is mounted on a carriage 62. An ink supply tube 63 is connected to the ink supply port 21 of the print head 1. The LSI chip 51 is incorporated in the carriage 62. A flexible cable 64 protrudes from the carriage 62 and is connected to a control center (not shown). The flexible cable 64 encloses the clock line 52, the data line 53, the voltage line 54, and the ground line 55. The carriage 62 is capable of moving along a slider 66 over an entire width of a recording paper 71 in both directions 65. When the carriage 62 is moving, the ink jet print head 1 ejects ink droplets from the nozzles 32. This deposits ink droplets on the recording paper 71 supported on a platen roller 72.

More specifically, the recording paper 71 is stationary when the ink droplets are ejected from the ink jet print head 1. However, each time the carriage 62 performs a predetermined moving operation, the recording paper 71 is moved a fixed amount in a direction 75 by a pair of paper feed rollers 73 and 74. As a result, the ink jet print head 1 is able to form a desired character or image over the entire surface of the recording paper 71.

In the above-described ink jet print head 1, as shown in FIG. 1, only the upper half of each side wall 11 is provided with the electrode 13. The top surface of each side wall 11 is fixedly bonded to the cover plate 3. With this structure, only the upper half of the side wall 11 is applied with the driving voltage, and is deformed due to the piezoelectric thickness shear effect. The lower half is deformed following the upper half. Accordingly, the side wall 11 is bent at its middle portion as shown in FIG. 2.

According to this deformation mechanism, the side wall 11 can not be deformed with a large amount. The side wall 11 is deformed with a relatively small amount in comparison with the amount of the electric energy applied to the electrode 13. It is impossible to obtain a large volume reduction of the ink chamber 12. For this reason, a high driving voltage has to be applied to the electrode 13 in order that the ink chamber 12 will eject ink droplets that have a velocity and a volume sufficient to form high quality images on the paper 71 located opposite the ink jet print head 1. Accordingly, a relatively complicated and large sized driving circuit has to be connected to the voltage line 54. This will limit lowering the cost and miniaturizing the printer.

In order to solve this problem, the print head 1 can be modified into a two actuator plate type print head 101 as shown in FIGS. 6 and 7.

This print head 101 is constructed from two actuator plates 102 and 103, which are substantially identical to the actuator 2. The actuator plate 102 is polarized in an upward direction 105. The actuator plate 102 is formed with grooves 115 and side walls 111 separating the grooves 115. As shown in FIG. 7, a pair of electrodes 113 are formed over both side surfaces of each side wall 111. The electrodes 113 entirely cover the both side surfaces of the side wall 111. The electrodes 113 further cover both edge areas of the top surface of the side wall 111.

As shown in FIG. 6, the actuator plate 103 is polarized in a downward direction 106. The actuator plate 103 is formed with grooves 117 and side walls 116 separating the grooves 117. A pair of electrodes 114 are formed over both side surfaces of each side wall 116. As shown in FIG. 7, the electrodes 114 entirely cover the both side surfaces of the side wall 116. The electrodes 114 further cover both edge areas of the top surface of the side wall 116.

The top surfaces of the actuator plates 102 and 103 are connected to each other so that the polarizing directions 105 and 106 are opposite with each other. In more concrete terms, a top surface of each side wall 111 is connected to a top surface of a corresponding side wall 116 via an adhesive layer 104. As clearly shown in FIG. 7, the adhesive layer 104 is provided between the top surfaces of the side walls 111 and 116 where the electrodes 113 and 114 are not formed. Accordingly, the electrodes 113 are contacted with the electrodes 114 at their top areas. Thus, the electrodes 113 and 114 are electrically connected with each other.

Thus connected side walls 111 and 116 form a single side wall 118. The side wall 118 has substantially twice as high as the side wall 11 of the print head 1. Each groove 115 and a corresponding groove 117 communicates with each other to form a single ink chamber 112. The volume of the ink chamber 112 is substantially twice as large as that of the ink chamber 12 of the print head 1.

According to the thus constructed two plate type print head 101, both sides of each side wall 111 are entirely covered with electrodes 113. Similarly, both sides of each side wall 116 are entirely covered with electrodes 114. The connected portion of the side walls 111 and 116 is freely movable. The electrodes 113 and 114 are electrically connected with each other. Accordingly, when driving voltages are applied to both the electrodes 113 and 114, the side walls 111 and 116 are entirely deformed due to the piezoelectric thickness shear effect so that they are bent at their connected portion. Accordingly, the side wall 118 can be bent with an amount substantially twice as large as the amount, with which the side wall 11 of FIG. 2 is bent. The print head 101 can therefore generate the same ink pressure as does the ink jet print head 1 even when applied with only a half the driving voltage applied to the ink jet print head 1. The print head 101 can thus be driven with a driving voltage less than that applied to the ink jet print head 1. Accordingly, the print head 101 can be employed with a simpler driving circuit, and therefore can be produced with a lower production cost.

Additionally, the actuator plates 102 and 103 can be more reliably driven. The piezoelectric ceramic constituting the actuator plates have to be driven with a driving voltage lower than a predetermined amount of limit voltage. If a voltage higher than the limit voltage is applied to the actuator plates, the polarization formed in the piezoelectric ceramic will be broken down. According to this two actuator type print head, however, the actuator plates can be driven with a voltage sufficiently lower than the limit voltage. Accordingly, it is possible to drive the actuator plates with higher reliability.

It is noted, however, that if the top surfaces of the side walls 111 and 116 have corrugations and have high degree of surface roughness, the electrodes 113 and 114 will not be properly connected. The adhesive agent 104 may possibly enter between the electrodes 113 and 114, thereby separating the electrodes from each other. Ink in the ink chamber 112 may also enter between the electrodes 113 and 114 to separate them from each other. While the print head 101 is operating, the side walls 118 are repeatedly bent. Due to this oscillating motion of the side walls 118, the electrodes 113 and 114 rub against each other at their contacted areas. The electrodes 113 and 114 will be possibly worn out and separated from each other. In this case, the print head 101 will suddenly stop ejecting ink droplets. According to the above-described several possibilities, the print head 101 is very low at its reliability.

SUMMARY OF THE INVENTION

An object of the present invention is therefore to provide a reliable ink jet print head which is capable of ejecting ink droplets of velocity and volume sufficient to form a good quality image even at a low driving voltage.

In order to solve this and other objects, the present invention provides an ink jet print head for ejecting ink droplets, the ink jet print head comprising: a first actuator plate formed with a plurality of first side walls, a plurality of first grooves being defined between the plurality of first side walls, at least a part of each first side wall being made of piezoelectric material, a first electrode being formed on at least a part of side surfaces of each first side wall to develop an electric field through the first side wall; and a second actuator plate formed with a plurality of second side walls, a plurality of second grooves being defined between the plurality of second side walls, at least a part of each second side wall being made of piezoelectric material, a second electrode being formed on at least a part of side surfaces of each second side wall to develop an electric field through the second side wall, the second actuator plate being connected to the first actuator plate so that a top surface of each first side wall being connected to a top surface of a corresponding second side wall, each first groove being communicated with a corresponding second groove to form an ink chamber, a third electrode being provided in each ink chamber to electrically connect the corresponding first electrode to the corresponding second electrode, the connected first and second side walls being deformed due to the electric field developed therethrough to thereby apply pressure in ink filled in the ink chamber.

According to another aspect, the present invention provides a method of producing an ink jet print head for ejecting ink droplets, the method comprising the steps of: producing a first actuator plate and a second actuator plate, the first actuator plate being formed with a plurality of first side walls, a plurality of first grooves being defined between the plurality of first side walls, at least a part of each first side wall being made of piezoelectric material, a first electrode being formed on at least a part of side surfaces of each first side wall, the second actuator plate being formed with a plurality of second side walls, a plurality of second grooves being defined between the plurality of second side walls, at least a part of each second side wall being made of piezoelectric material, a second electrode being formed on at least a part of side surfaces of each second side wall; connecting the second actuator plate to the first actuator plate through connecting a top surface of each first side wall to a top surface of a corresponding second side wall, thereby causing each first groove to be communicated with a corresponding second groove to form an ink chamber; and forming a third electrode in each ink chamber for electrically connecting the corresponding first electrode to the corresponding second electrode.

The third electrode forming step may include a step of introducing at least one of metal material and metal ion into each ink chamber through one open end of the ink chamber so as to form the third electrode. The metal introducing step may include a metal plating step for forming the third electrode over at least a part of the first electrode and at least a part of the second electrode through a metal plating process.

The third electrode forming step may include a step of ejecting conductive material into each ink chamber through one open end of the ink chamber so as to form the third electrode. The conductive material ejecting step includes a vacuum evaporation step for forming the third electrode through a vacuum evaporation process. The conductive material ejecting step may include a sputtering step for forming the third electrode through a sputtering process.

According to a further aspect, the present invention provides a method of producing an ink jet print head for ejecting ink droplets, the method comprising the steps of: connecting a first actuator plate to a second actuator plate, the first actuator plate being formed with a plurality of first side walls, a plurality of first grooves being defined between the plurality of first side walls, at least a part of each first side wall being made of piezoelectric material, a first electrode being formed on at least a part of side surfaces of each first side wall, the second actuator plate being formed with a plurality of second side walls, a plurality of second grooves being defined between the plurality of second side walls, at least a part of each second side wall being made of piezoelectric material, a second electrode being formed on at least a part of side surfaces of each second side wall, the first actuator plate being connected to the second actuator plate through connecting a top surface of each first side wall to a top surface of a corresponding second side wall, thereby causing each first groove to be communicated with a corresponding second groove to form an ink chamber; and forming a third electrode in each ink chamber for electrically connecting the corresponding first electrode to the corresponding second electrode.

BRIEF DESCRIPTION OF THE DRAWINGS

The above and other objects, features and advantages of the invention will become more apparent from reading the following description of the preferred embodiment taken in connection with the accompanying drawings in which.

DETAILED DESCRIPTION OF THE PREFERRED EMBODIMENTS

Figure 1:
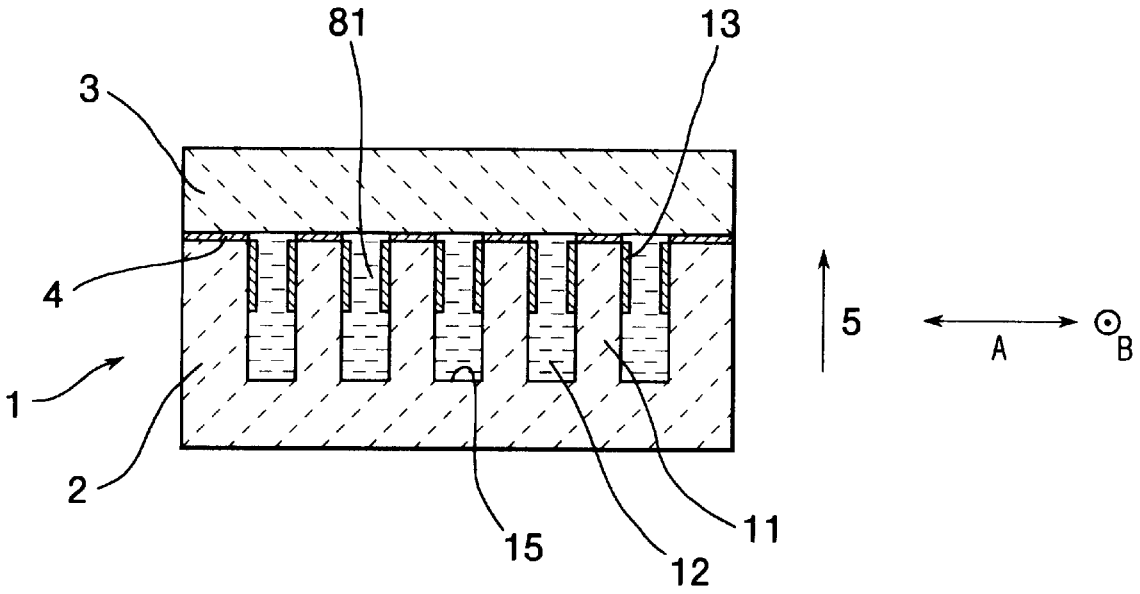
FIG. 1 (PRIOR ART)
FIG. 1 is a cross-sectional view of an actuator of a conceivable ink Jet print head taken along a line I–I' in FIG. 3.
Figure 2:
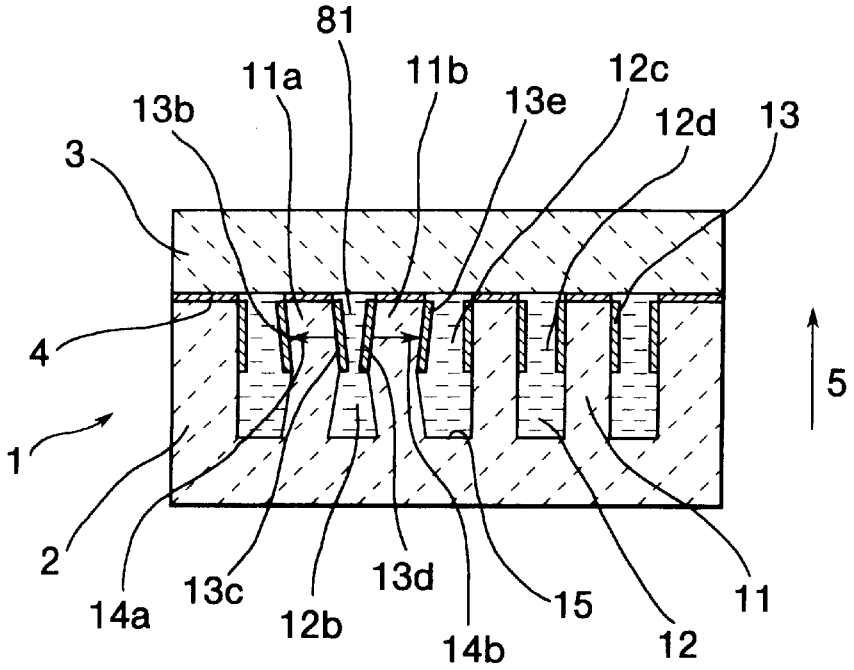
FIG. 2 (PRIOR ART)
FIG. 2 illustrates the operation of the ink jet print head actuator of FIG. 1.

An ink jet print head according to preferred embodiments of the present invention will be described while referring to the accompanying drawings wherein like parts and components are designated by the same reference numerals as those shown in FIGS. 1 through 7 to avoid duplicating description.

First, a first preferred embodiment of the present invention will be described with reference to FIGS. 8(A) through 11.

Figure 11:
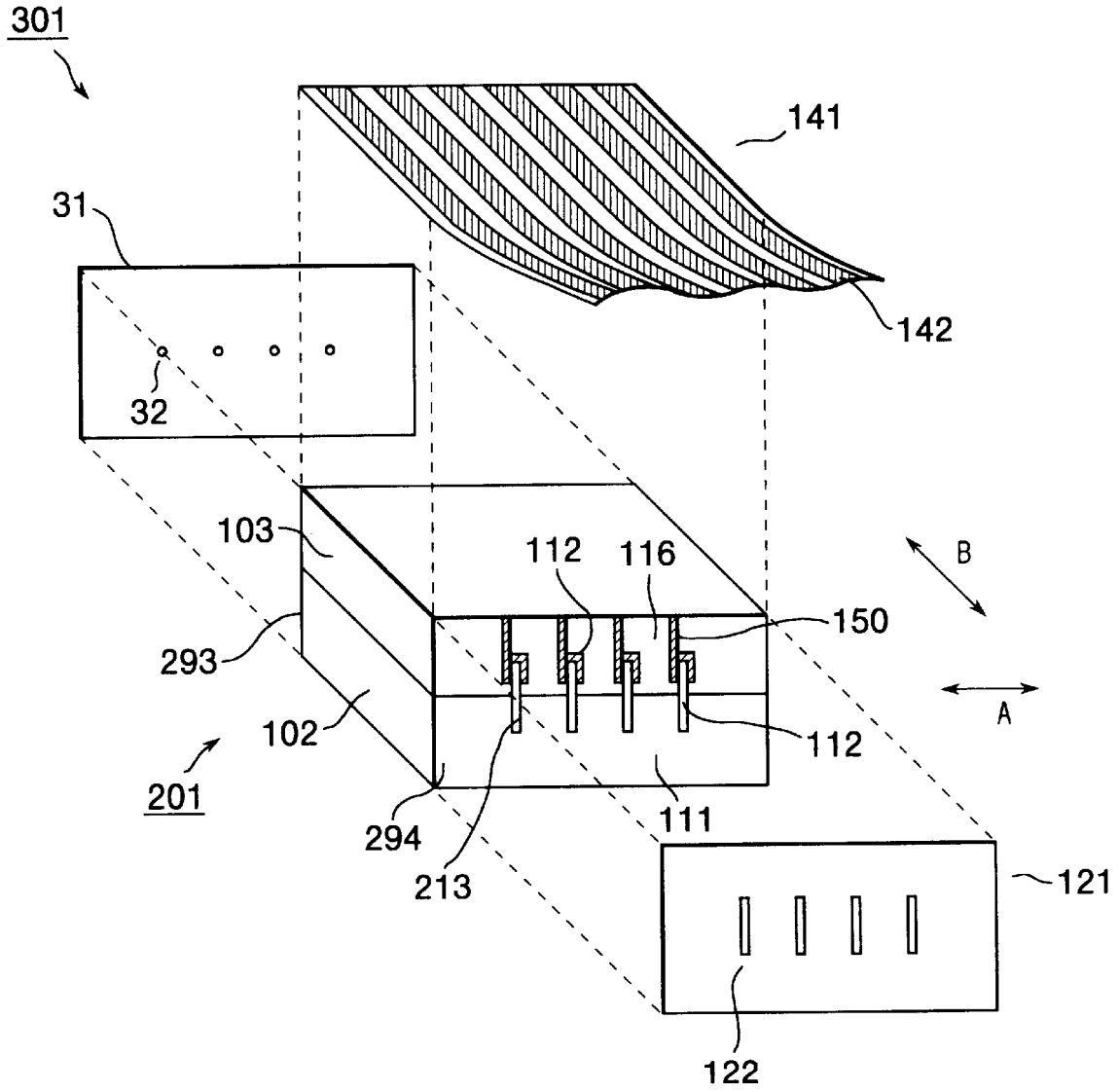
FIG. 11 is a perspective view illustrating how to assemble the ink jet print head according to the embodiment of the present invention.

As shown in FIG. 11, according to the first embodiment of the present invention, an ink jet print head 301 is mainly constructed from: an actuator portion 201 constructed from two actuator plates 102 and 103; a nozzle plate 31; and a flexible driving plate 141.

Figure 10:
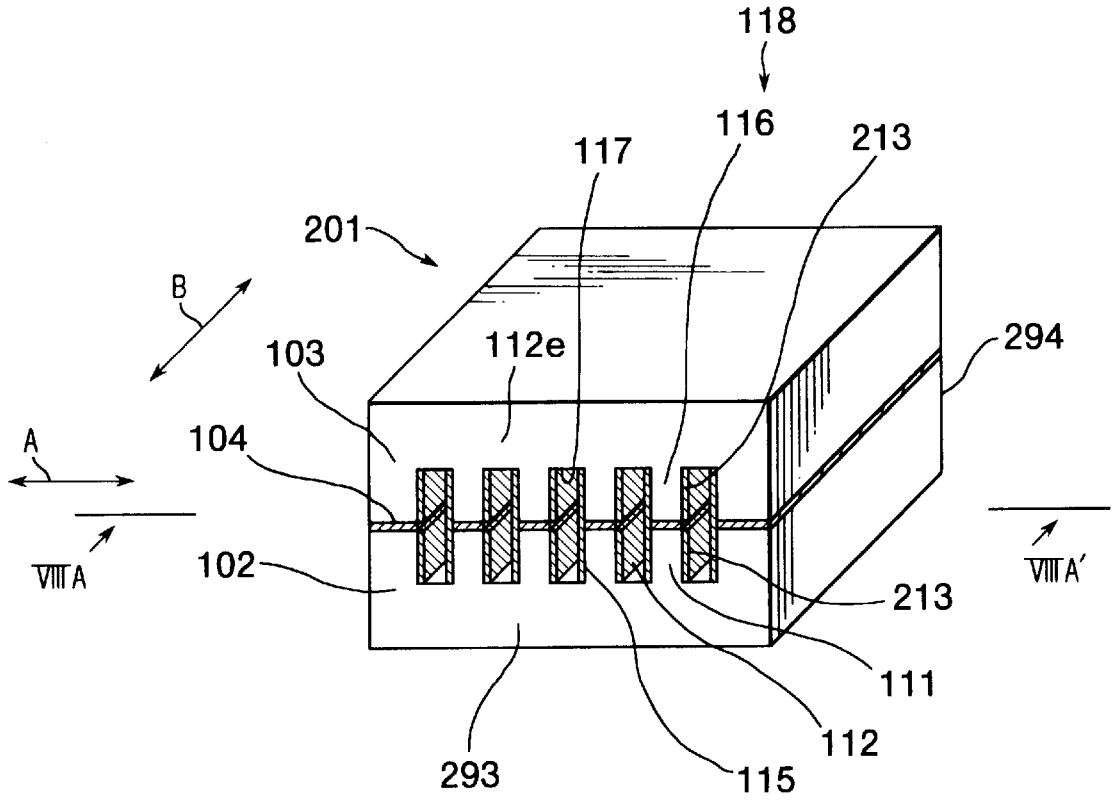
FIG. 10 is a perspective view of the actuator portion of FIG. 8(A)

FIGS. 8(A) and 10 show the actuator portion 201 of the present embodiment. Each of the actuator plates 102 and 103 constituting the actuator portion 201 has substantially the same configuration with the actuator plate 2 shown in FIG. 3. That is, the actuator plate 102 is made from a piezoelectric material having ferroelectric properties. The actuator plate 102 is polarized in an upward direction indicated by an arrow 105, and has a plurality of grooves 115 and side walls 111 separating the grooves 115. The grooves 115 are therefore arranged with a certain interval in a horizontal direction A which is perpendicular to the direction 105. The grooves 115 extend along another horizontal direction B which is perpendicular to both the directions A and 105. The side walls 111 extend over the entire length of the grooves 115. As clearly shown in FIG. 9, a pair of electrodes 113 are formed on both side surfaces of each side wall 111. The electrodes 113 entirely cover the side surfaces of the side wall 111 and further extend to cover the edge portions of the top surface of the side wall 111.

Similarly, the actuator plate 103 is made from the piezoelectric material having the ferroelectric properties. The actuator plate 103 is polarized in a downward direction indicated by an arrow 106. Thus, the actuator plates 102 and 103 are polarized in opposite directions. The actuator plate 103 has a plurality of grooves 117 and side walls 116 separating the grooves 117. The grooves 117 are arranged with the certain interval in the horizontal direction A. The grooves 117 extend along the horizontal direction B. The side walls 116 extend over the entire length of the grooves 117. As clearly shown in FIG. 9, a pair of electrodes 114 are formed on both side surfaces of each side wall 116. The electrodes 114 entirely cover the side surfaces of the side wall 116 and further extend to cover the edge portions of the top surface of the side wall 116.

The top surfaces of the actuator plates 102 and 103 are connected to each other. That is, a top surface of each side wall 111 is connected to a top surface of a corresponding side wall 116 via an adhesive layer 104. As clearly shown in FIG. 9, the adhesive layer 104 is provided between the central areas of the top surfaces of the side walls 111 and 116 where the electrodes 113 and 114 are not formed. Thus connected side walls 111 and 116 form a single side wall 118. Each groove 115 and a corresponding groove 117 communicates with each other to form a single ink chamber 112. Thus, the actuator portion 201 has the ink chambers 112 arranged in the direction A with the certain interval.

According to the present embodiment, another electrode 213 is formed over both the electrodes 113 and 114. The electrode 213 can provide a reliable electric connection between the electrodes 113 and 114. That is, the electrical connection can be certainly achieved regardless of whether the side walls 111 and 116 have highly rough top surfaces. The electrical connection will not be damaged due to the adhesive agent 104, the ink in the ink chamber 112, or the oscillating motion of the side walls 111 and 116.

Next will be described the method of manufacturing the actuator portion 201 having the above-described structure.

Figure 3:
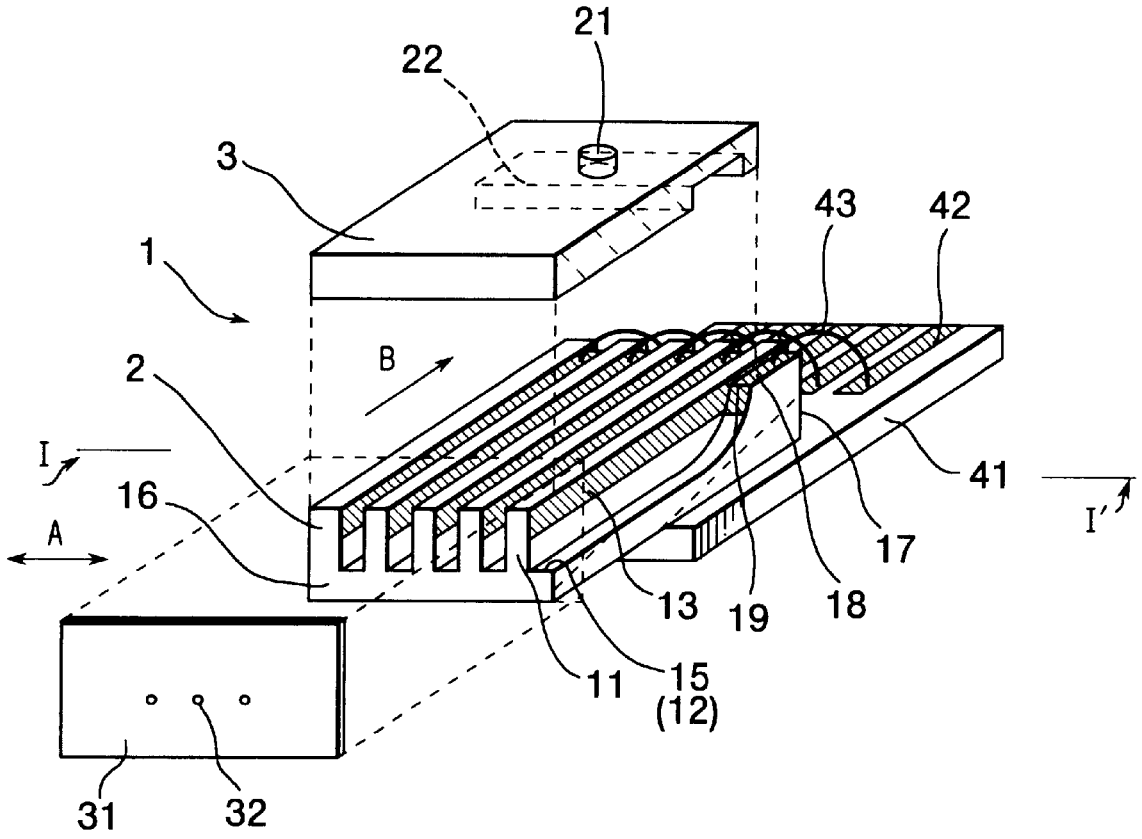
FIG. 3 (PRIOR ART)
FIG. 3 is a perspective view illustrating how the ink jet print head is assembled.
Figure 4:
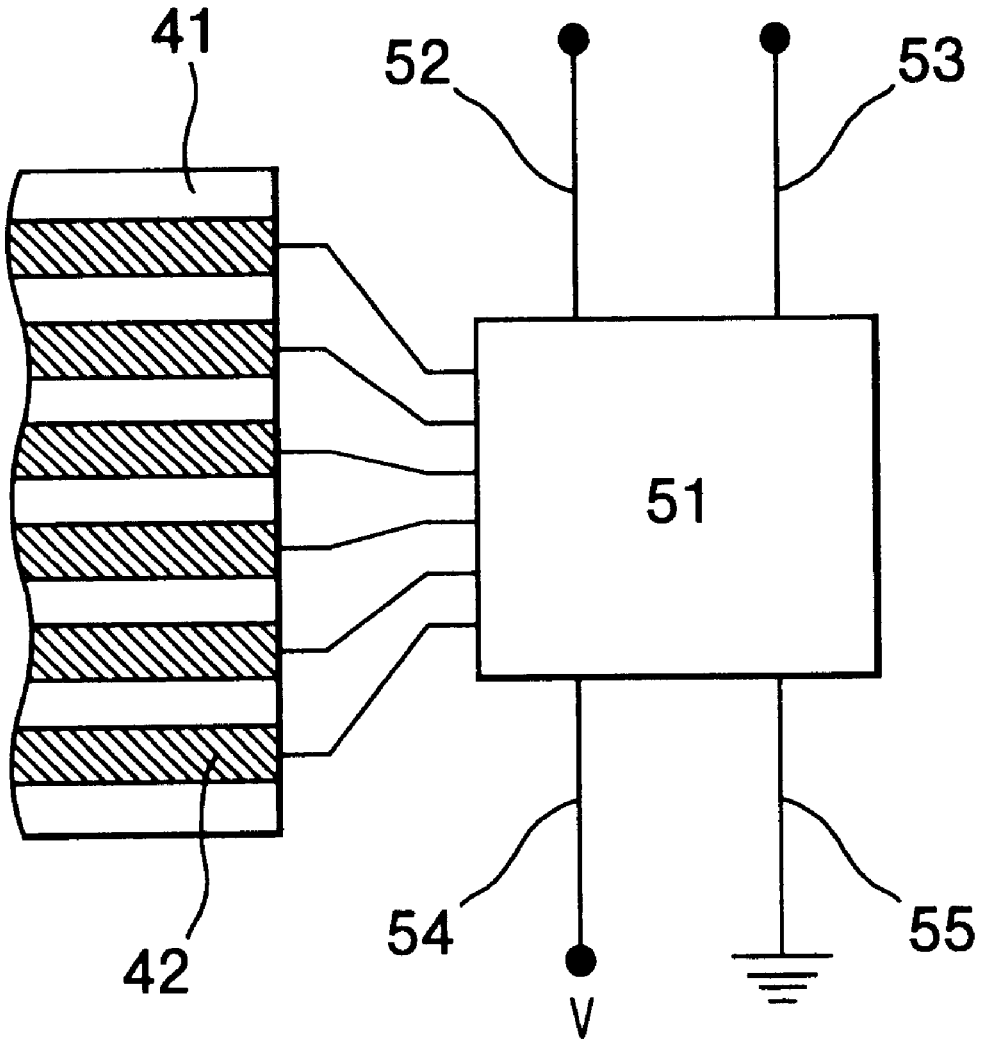
FIG. 4 (PRIOR ART)
FIG. 4 is a block diagram of a control unit for the ink jet print head.
Figure 5:
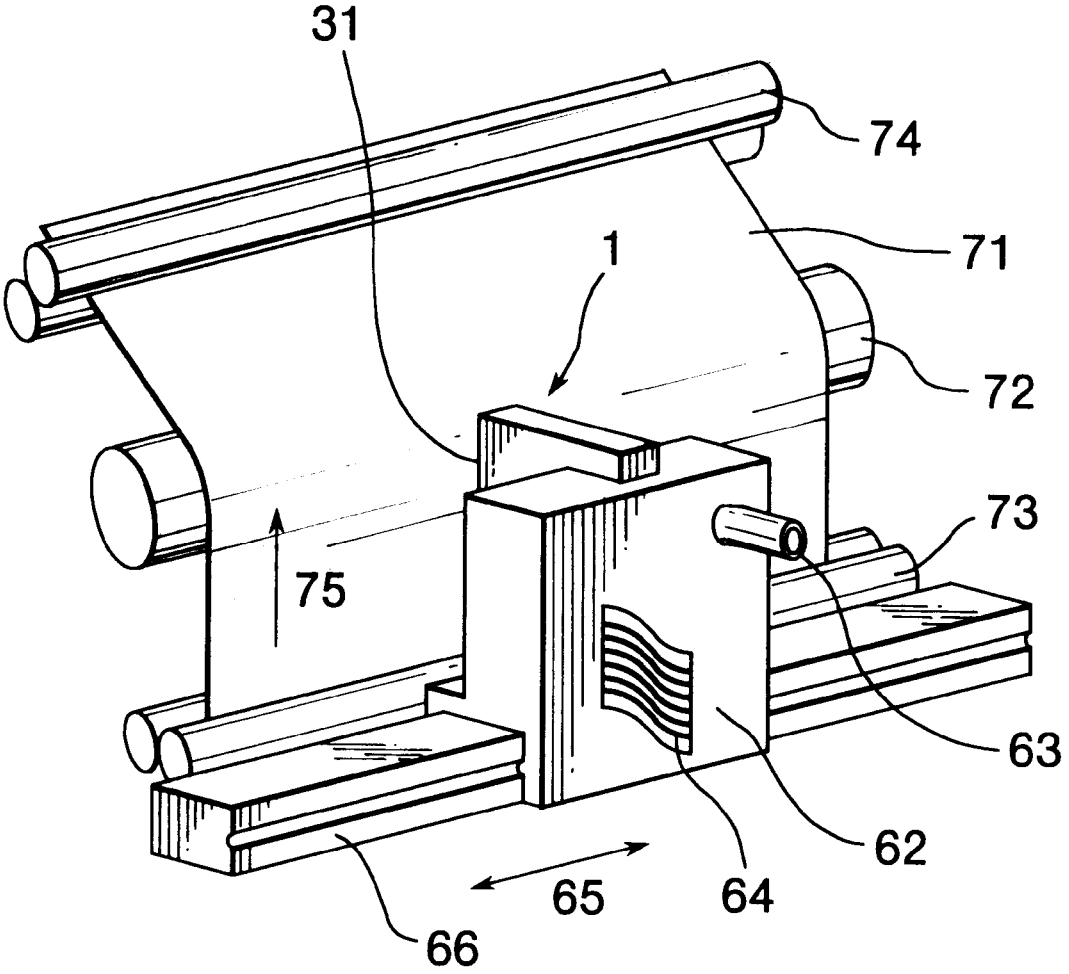
FIG. 5 (PRIOR ART)
FIG. 5 is a perspective view of a printer employed with the ink jet print head.
Figure 6:
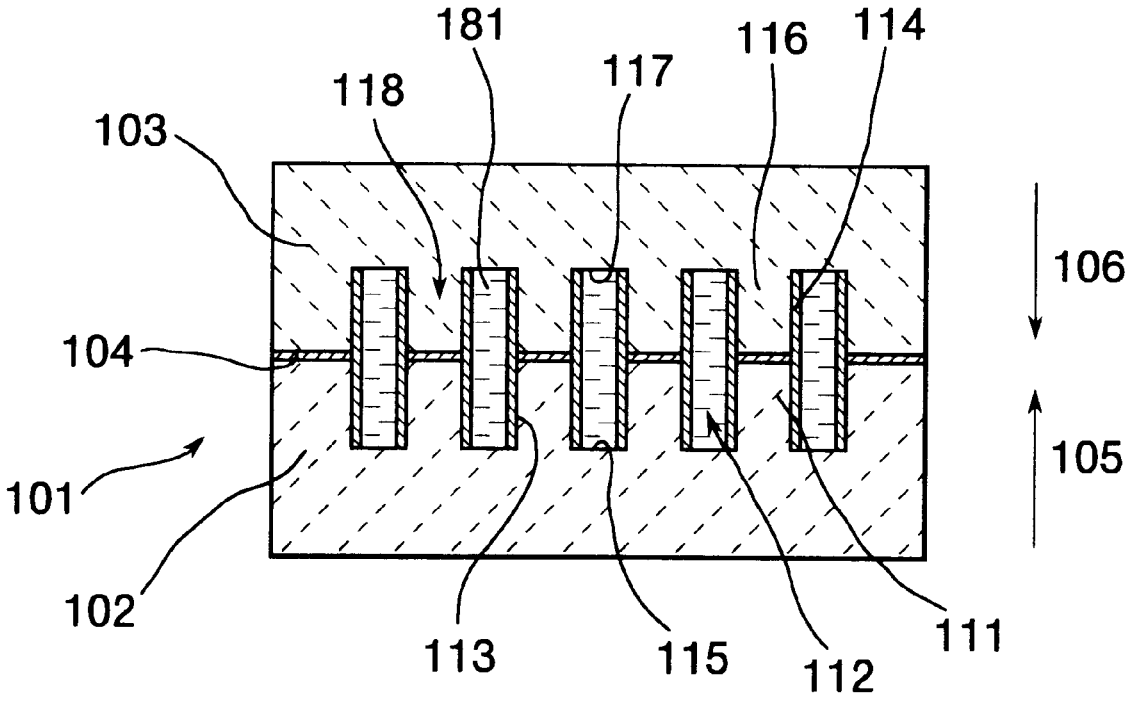
FIG. 6 (PRIOR ART)
FIG. 6 is a cross-sectional view of another conceivable ink jet print head actuator.
Figure 7:
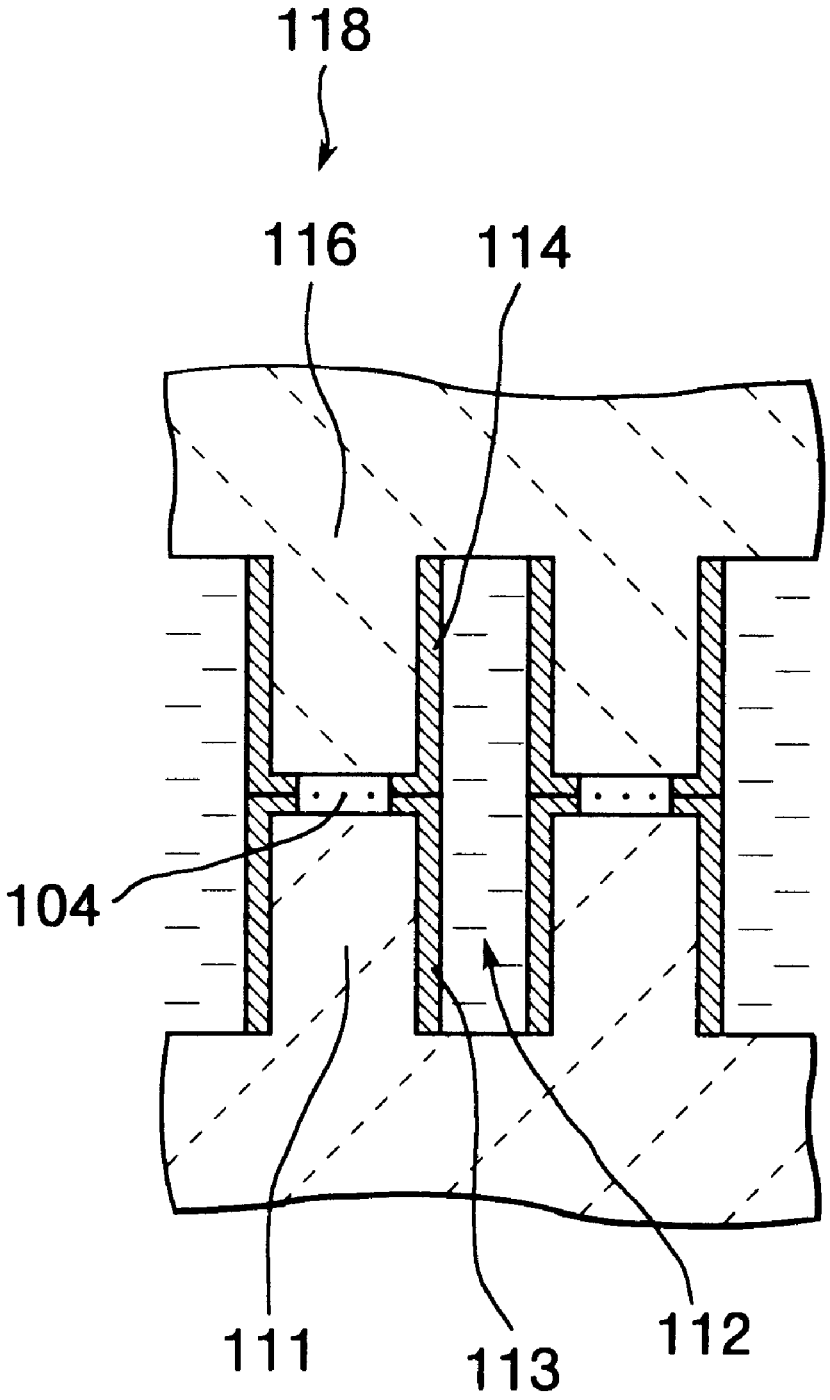
FIG. 7 (PRIOR ART)
FIG. 7 is an enlarged cross-sectional view of an essential part of the ink jet print head actuator of FIG. 6.
Figure 8:
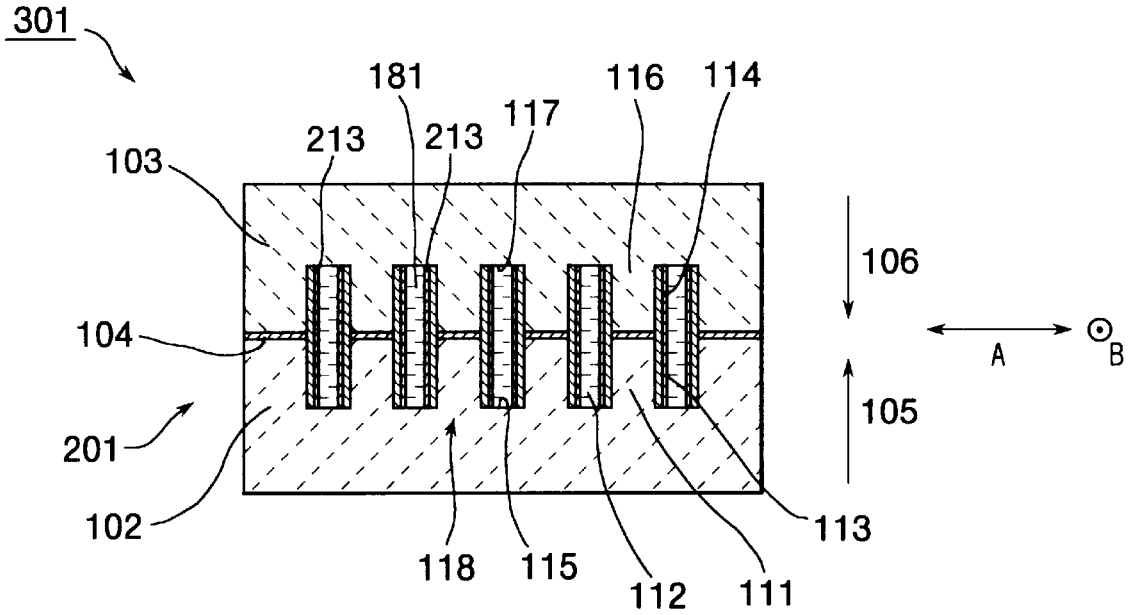
FIG. 8(A) is a cross-sectional view of an actuator portion of an ink jet print head, according to a first preferred embodiment of the present invention, taken along a line VIIIA–VIIIA' in FIG. 10.
FIG. 8(B) illustrates the operation of the actuator portion of FIG. 8(A)
Figure 8:
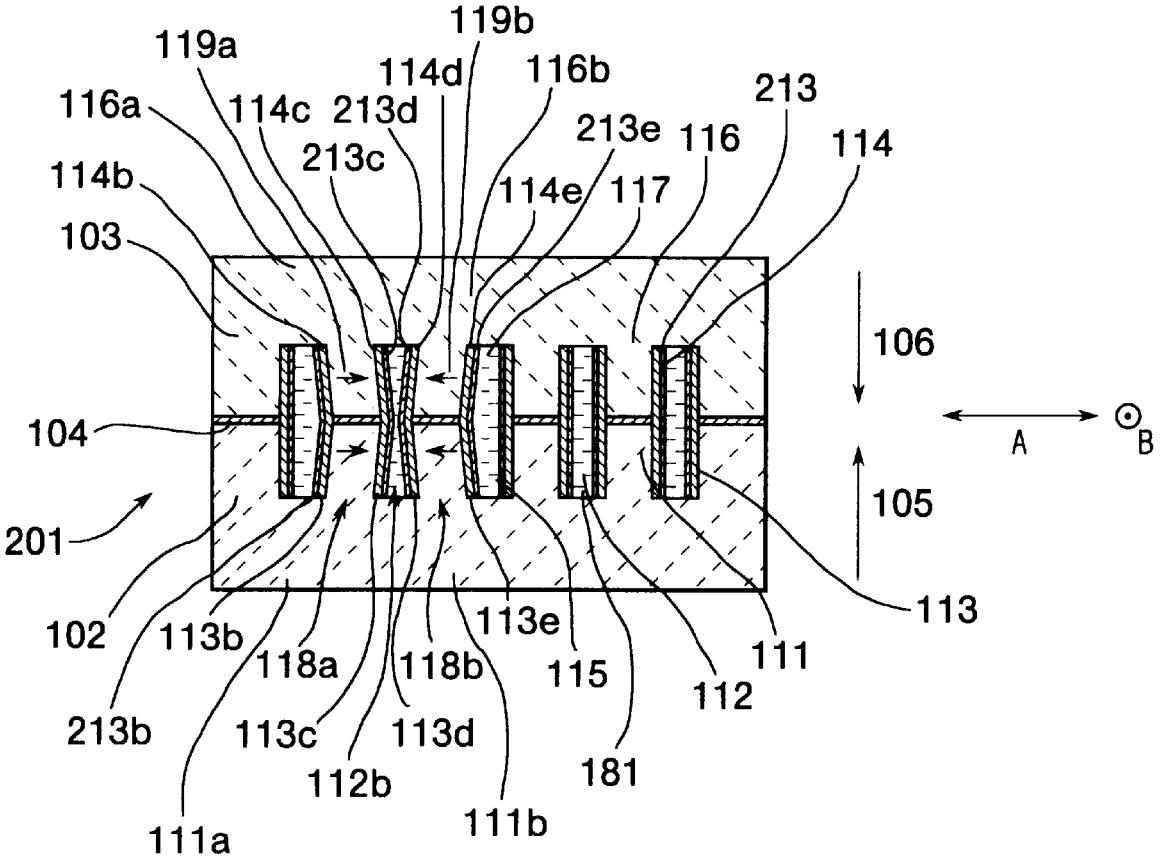
Figure 9:
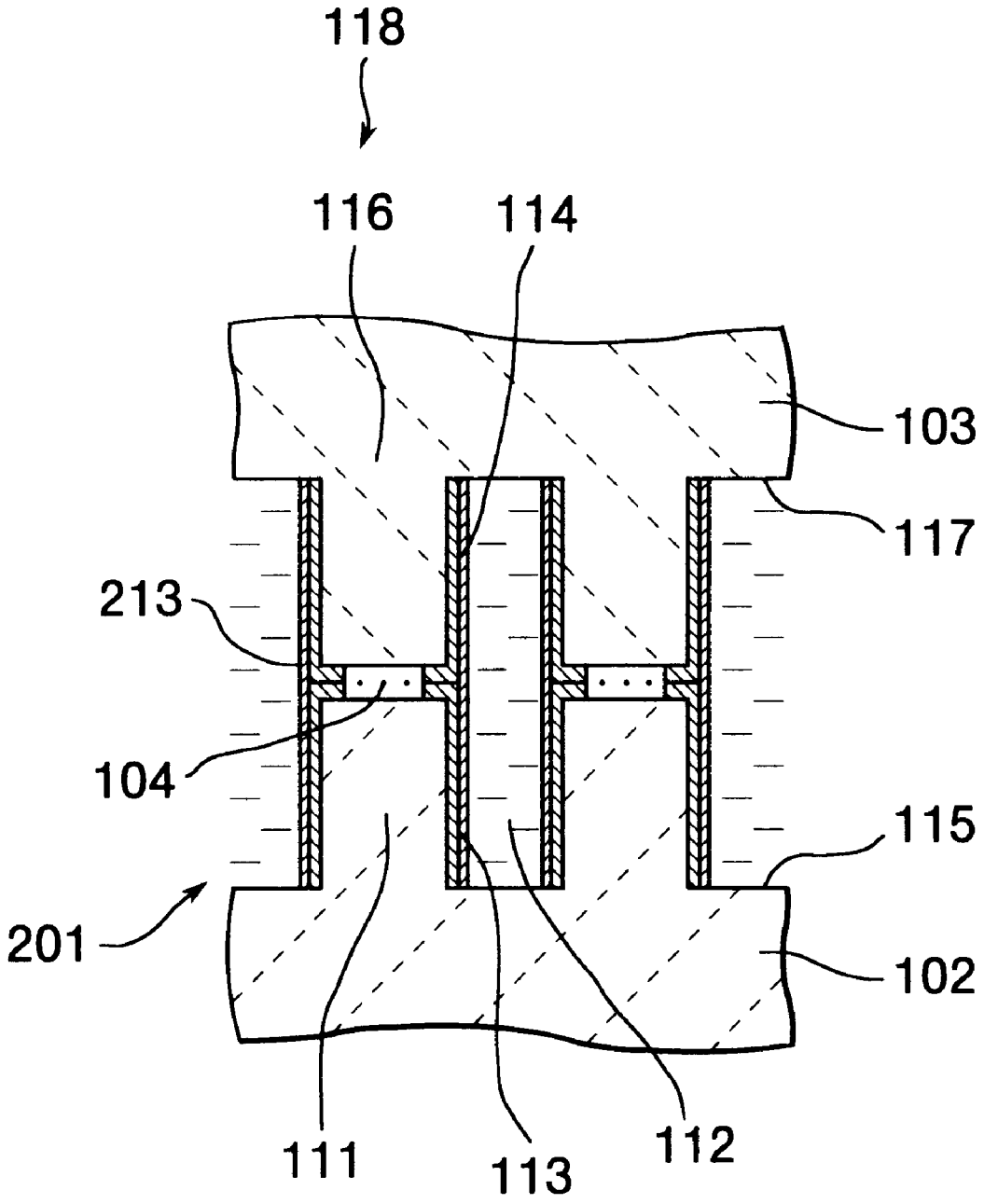
FIG. 9 is an enlarged cross-sectional view of an essential part of the actuator portion of FIG. 8(A)

The actuator plate 102 can be produced through substantially the same procedure for producing the actuator plate 2 of FIG. 3.

That is, an actuator plate 102 which has been polarized in the direction 105 is first subjected to a grinding process using a thin disk-shaped diamond blade. The grinding process forms the parallel grooves 115 each being sandwiched between two adjacent side walls 111. The grooves 115 extend from a front end surface 293 of the actuator plate 102 toward the rear end surface 294. The grooves 115 have the same depth all over the whole actuator plate 102. Though the actuator plate 2 of FIG. 3 is formed with shallow grooves 18 at the rear ends of the grooves 15, the grooves 115 of the present embodiment may not be formed with such shallow grooves. However, those shallow grooves 18 may be formed to the grooves 115.

Then, the pair of electrodes 113 are formed on both side surfaces of each side wall 111 in the following manner. First, the central areas of the top surface of the side wall 111 is patterned and formed with a resist layer. Then, a thin layer of conductive material is formed entirely over the side wall 111 through a process such as a vacuum evaporation method, a sputtering method, a metal plating method, and a screen printing method. Examples of the conductive material include: nickel, aluminum, gold, carbon, and the like. Then, the resist layer is removed from the side wall 111 through a mechanical peeling process or a chemical dissolving process. As a result, a part of the conductive layer formed on the resist layer is removed from the side wall 111 together with the resist layer. Thus, the electrode layer is removed from the central area of the top surface. The electrode layer 113 remains on the both side surfaces of the side wall 111, and remain also on the edges of the top surface of the side wall 111.

The actuator plate 103 can be produced through the same procedure as described above for the actuator plate 102. When the actuator plates 102 and 103 are both produced, the top surfaces of the side walls 111 are bonded by the adhesive layer 104 to the top surfaces of the side walls 116. The adhesive layer 104 is provided between the central areas of the top surfaces of the side walls 111 and 116 where the electrodes 113 and 114 are not formed. Each side wall 111 and a corresponding side wall 116 is therefore joined into a single side wall 118. Each groove 115 is communicated with a corresponding groove 117 to form a single ink chamber 112. Similarly to the actuator plate 2 of FIG. 3, the thus formed ink chambers 112 have an elongated shape with a rectangular cross-section. The ink chambers 112 extend along the direction B. The side walls 118 extend over the entire length of the ink chambers 112. The electrodes 113 and 114 provided on the both side surfaces of the side walls 118 are for applying a driving voltage through the side walls 118.

Then, the electrodes 213 are formed over the electrodes 113 and 114 on both inner sides of each ink chamber 112 in the following manner.

Metal material or metal ion is introduced into each ink chamber 112 through its front open end 112*e*, which is located on the front end surface 293 of the actuator portion 201 as shown in FIG. 10. For example, liquid containing metal or metal ion is introduced into each ink chamber 112 through the corresponding front open end 112*e*. Then, the introduced metal or metal ion is caused to be located on the surfaces of the electrodes 113 and 114 on both inner sides of the ink chamber 112. Examples of the material for the metal and the metal ion include: nickel, gold, copper, silver, and palladium.

For example, the metal material is provided onto the electrodes 113 and 114 through a metal plating method. That is, a metal ion solution, i.e., a liquid containing dissolved metal ion, is introduced into each ink chamber 112. The electrodes 113 and 114 are therefore immersed in the metal ion solution, and a corresponding metal is deposited on the electrodes. Thus, the electrodes 213 are formed over the electrodes 113 and 114. It is noted that thus produced electrodes 213 may further be sintered through a thermal process.

Examples of the plating process include: an electrolytic plating method (or an electroplating method) and an electroless plating method.

In the electrolytic plating method, a metal ion solution is introduced into each ink chamber 112. Then, the electrodes 113 and 114 in the subject ink chamber are applied with electric voltages so that metal ion moves toward these electrodes. When reaching the surfaces of these electrodes, metal ion receives electrons from the electrodes, and a corresponding metal is plated out on the electrode surfaces. Electrodes 213 are thus formed entirely over the electrodes 113 and 114. Electric voltages are applied to both inner sides of the ink chamber in succession so that the electrodes 213 are formed on the both inner sides of each ink chamber 112. It is noted that thus produced electrodes 213 may further be sintered through a thermal process.

In the electroless plating method, on the other hand, electrodes 113 and 114 are applied with no electric voltages. Metal ion in the introduced metal ion solution is reduced and deposited on the electrodes 113 and 114. Thus produced electrodes 213 may further be sintered.

Or otherwise, a liquid, in which metal particles are floating, may be introduced into each ink chamber 112. The electrodes 113 and 114 are applied with electric voltages similarly in the above-described electrolytic plating method so that metal particles be placed on the electrodes 113 and 114 to form the electrode layer 213. Thus obtained metal electrodes 213 may further be sintered through a thermal process.

The ink jet print head 301 of the present embodiment can be assembled as shown in FIG. 11 from the actuator portion 201 produced as described above.

That is, a nozzle plate 31 is bonded to the front end surface 293 of the actuator portion 201. Electrode patterns 150 are formed on a rear end surface 294 of the actuator portion 201. The electrode patterns 150 are connected with the rear tip ends of the electrodes 213 located at the rear ends of the ink channels 112.

Figure 15:
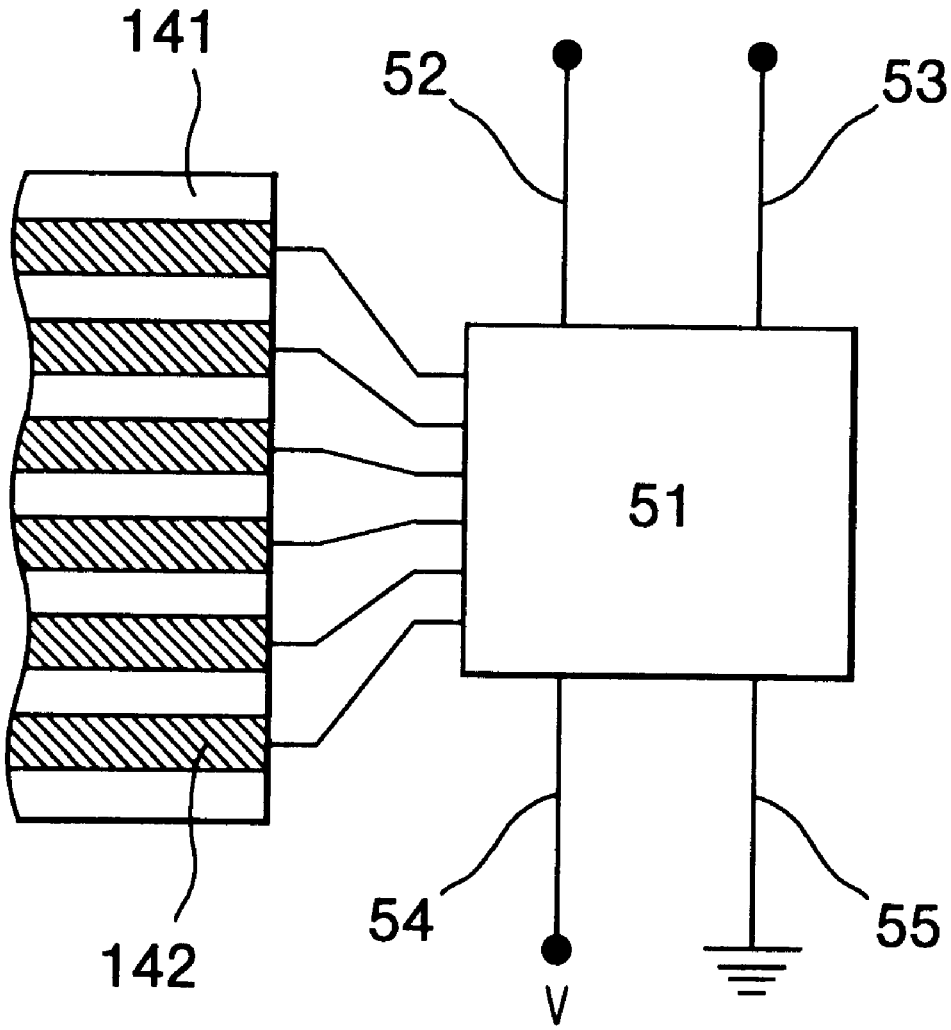
FIG. 15 is a block diagram of a control unit for one embodiment of the invention.

According to the present embodiment, a flexible electrode-printed plate 141 is attached to an upper surface of the actuator portion 201 through a soldering method. As shown in FIG. 15, the flexible plate 141 is formed with conductor layer patterns 142 similarly to the driving substrate 41 of FIG. 3. Each conductor layer pattern 142 is electrically connected to a corresponding electrode pattern 150. One end of each conductor layer pattern 142 is electrically connected to the LSI chip 51 in the control unit of FIG. 15.

Although not shown in the drawings, the electrode patterns 150 may be formed on the front end surface 293 of the actuator portion 201. The electrode patterns 150 may be connected to the front tip ends of the electrodes 213 located at the front ends 112*e* of the ink chambers 112. The electrode patterns 150 thus formed on the front end surface may be connected to the conductor patterns 142 on the flexible plate 141.

An ink seal plate 121 is bonded to the rear end surface 294 of the actuator portion 201. The ink seal plate 121 is formed with a plurality of through-holes (ink introduction portion) 122, through which the ink channels 112 are communicated with a manifold (not shown). An ink supply port (not shown) is connected to the manifold. Ink 181 is therefore introduced to the ink chambers 112 from the ink supply port via the manifold. Thus assembled ink jet print head 301 is mounted to the ink jet printer shown in FIG. 5 in the same manner as the ink jet print head 1.

The ink jet print head 301 having the above-described structure operates as described below.

As shown in FIG. 8(B), when an ink chamber 112*b*, for example, is selected to eject an ink droplet according to desired print data, a negative driving voltage is applied to the electrodes 113*c*, 114*c*, 113*d* and 114*d* via the electrodes 213*c* and 213*d*. The electrodes 113*b*, 114*b*, 113*e*, and 114*e* are grounded via the electrodes 213*b* and 213*e*. Or otherwise, a positive driving voltage is applied to the electrodes 113*b*, 114*b*, 113*e*, and 114*e* via the electrodes 213*b* and 213*e* and the electrodes 113*c*, 114*c*, 113*d* and 114*d* are grounded via the electrodes 213*c* and 213*d*. As a result, an electric field is generated in a direction 119*a* through the side wall 118*a*. That is, the electric field 119*a* is generated in both the side walls 111*a* and 116*a* that constitute the side wall 118*a*. Similarly, an electric field is generated in a direction 119*b* in the side wall 118*b*. That is, the electric field 119*b* is generated in both the side walls 111*b* and 116*b* that constitute the side wall 118*b*. The directions 119*a* and 119*b* of the electric fields are substantially normal to the polarization directions 105 and 106. This makes the side walls 118*a* and 118*b* deform inwardly due to the piezoelectric thickness shear effect. In more concrete terms, both the side walls 111*a* and 116*a* are deformed so that the side wall 118*a* is bent at its middle portion, i.e., at the connecting area where the side walls 111*a* and 116*a* are connected. Similarly, both the side walls 111*b* and 116*b* are deformed so that the side wall 118*b* is bent at its middle portion, i.e., at the connecting area where the side walls 111*b* and 116*b* are connected. The deformation of the side walls 118*a* and 118*b* reduces the volume in the ink chamber 112*b*, thereby increasing the pressure of the ink 181 in the ink chamber 112*b*. This generates a pressure wave, whereby a portion of the ink 181 is ejected in the form of an ink droplet from a nozzle 32 connected with the ink chamber 112*b*. When the application of the driving voltage is stopped, the side walls 118*a* and 118*b* return to their original positions shown in FIG. 8(A). This reduces the pressure of the ink 181 in the ink chamber 112*b*, whereby an additional ink 181 is supplied into the ink chamber 112*b* from the ink supply port via the manifold and the ink seal plate 121.

In the above description, the driving voltage is applied in a direction so that the volume of the ink chamber 112*b* decreases, whereby an ink droplet is ejected from the ink chamber 112*b*. Alternatively, the driving voltage may be applied in an opposite direction so that the volume of the ink chamber 112*b* first increases and so that ink is additionally supplied to the ink chamber 112*b*. Then, the application of the driving voltage is stopped, whereby the side walls 118*a* and 118*b* return to their original positions shown in FIG. 8(A), thereby ejecting an ink droplet.

According to this two actuator type print head of the present invention, both the side walls 111 and 116 are entirely deformed to bend their constituting side wall 118. Accordingly, the side wall 118 can be largely bent even applied with a small driving voltage. The ink chamber 112 can therefore eject an ink droplet with velocity and volume sufficient to form characters and images even when applied with a low driving voltage.

Various modifications can be employed to the ink jet print head of the present embodiment.

For example, in the present embodiment, the resist layers are formed on the top surfaces of the side walls 111 and 116 before the conductive layers 113 and 114 are formed. The conductive layers are then partly removed from the top surfaces of the side walls together with the resist layers. However, the resist layers may not be formed. That is, conductive layers may be formed directly over the entire surfaces of the side walls 111 and 116. Then, the top surfaces of the side walls are mechanically processed so that the conductive layers may be partly removed from the top surfaces.

In the present embodiment, the electrodes 113 and 114 are formed to entirely cover the side surfaces of the side walls 111 and 116. The electrodes further extend to cover the edge portions, of the top surfaces, which are connected with the side surfaces. However, the electrodes may not be formed to cover the top surface edge portions. The electrodes may be formed only over the side surfaces. In addition, the electrodes may not cover the entire side surfaces. The electrodes may be formed to partly cover the side surfaces as shown in FIG. 1.

In the present embodiment, the electrodes 213 are provided to cover the entire side surfaces of the side walls 111 and 116. However, the electrodes 213 may be formed to partly cover the side surfaces of the side walls 111 and 116 so long as the electrodes 213 can electrically connect the electrodes 113 and 114. It is sufficient that each electrode 213 covers at least a portion of the electrode 113 and at least a portion of the corresponding electrode 114.

In the present embodiment, the electrodes 213 are formed to extend in the direction B with a whole length of the ink chamber 112. However, the electrodes 213 can be formed to extend at least in a part of the ink chamber 112 along the direction B. Preferably, the electrodes 213 can be formed at a portion of the ink chamber 112 near to the front open end 112*e*.

In the present embodiment, the adhesive layer 104 is formed between the central areas of the side wall top surfaces where the electrodes 113 and 114 are not formed. During the actuator portion producing process, there is a possibility that the adhesive agent will protrude from the adhesive layer 104 into between the contacted areas of the electrodes 113 and 114. In this case, the protruded adhesive agent is removed. For example, the protruded adhesive agent is dissolved with a solvent.

It is noted that the adhesive agent constituting the adhesive layer 104 may be added with conductive material powders such as metal powders. In this case, the protruded adhesive agent may not be removed. The electrode 213 may be formed directly over the protruded adhesive agent.

Next, a second preferred embodiment of the present invention will be described with reference to FIGS. 12 and 13.

Figure 12:
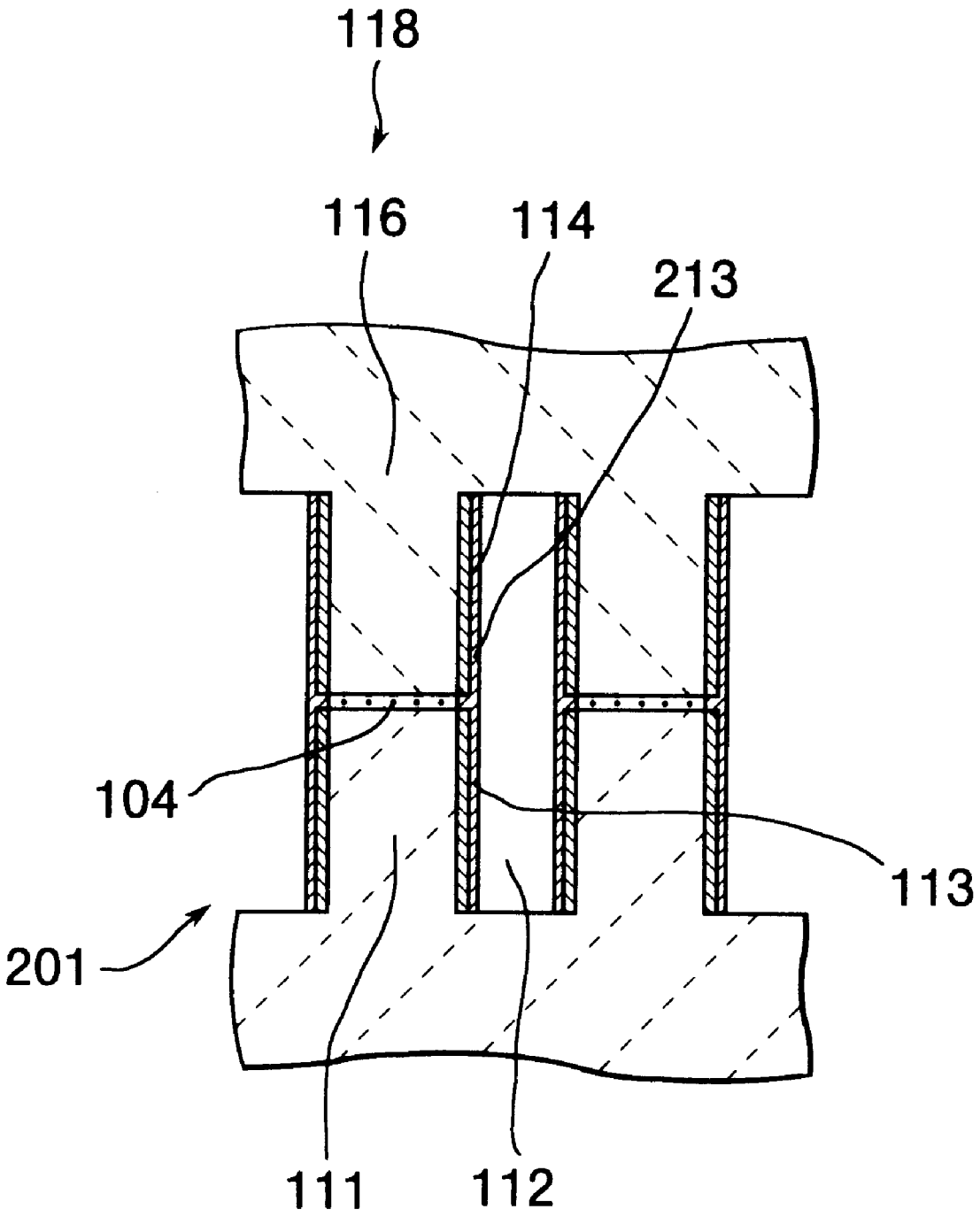
FIG. 12 is an enlarged cross-sectional view of an actuator portion of an ink jet print head, according to a second preferred embodiment of the present invention.

In the second embodiment, as shown in FIG. 12, the electrodes 113 and 114 are not formed on the top surface edges of the side walls 111 and 116. The electrodes are formed only on the side surfaces of the side walls. The electrodes may be formed through various methods. For example, the electrodes may be formed through substantially the same procedure as in the first embodiment except that the electrodes are removed from the entire top surfaces of the side walls. Or otherwise, the electrodes may be formed through substantially the same procedure as described for the print head 1 of FIG. 1 except that the entire side surfaces of the side walls are formed with the electrodes.

When the actuator plates 102 and 103 are connected with each other, the adhesive layer 104 is located between the top surfaces of the side walls 111 and 116 as shown in FIG. 12. The adhesive layer 104 is therefore formed between the entire top surfaces of the side walls 111 and 116. The electrodes 213 are formed covering both the electrodes 113 and 114 similarly as in the first embodiment.

According to the present embodiment, a pair of electrodes 213 are formed in each ink chamber 112 in the following manner.

Metal is ejected into the subject ink chamber 112 through its front open end 112*e*. More specifically, a metal source is located in the air atmosphere, in the vacuum atmosphere, or in a certain gas atmosphere. Metal material, such as metal molecules, metal clusters, and metal particles, is emitted from the metal source to fly toward the front open end 112*e*. The metal material then enters the subject ink chamber 112. The metal material collides against both inner side surfaces of the ink chamber 112 where the electrodes 113 and 114 are formed. The electrode layers 213 are thus deposited over the electrodes 113 and 114 on both inner side surfaces of the ink chamber 112.

Except for the above-described points, the print head 301 of the present embodiment is substantially the same as that of the first embodiment.

The method of producing the print head 301 of the present embodiment is described below.

First, the actuator plates 102 and 103 are produced in the same manner as in the first embodiment. Then, the actuator plates are connected with each other. As a result, the actuator portion 201 as described in FIG. 13 is obtained.

Then, electrodes 213 are formed on the inner side surfaces of each ink chamber 112 in the following manner.

Figure 13:
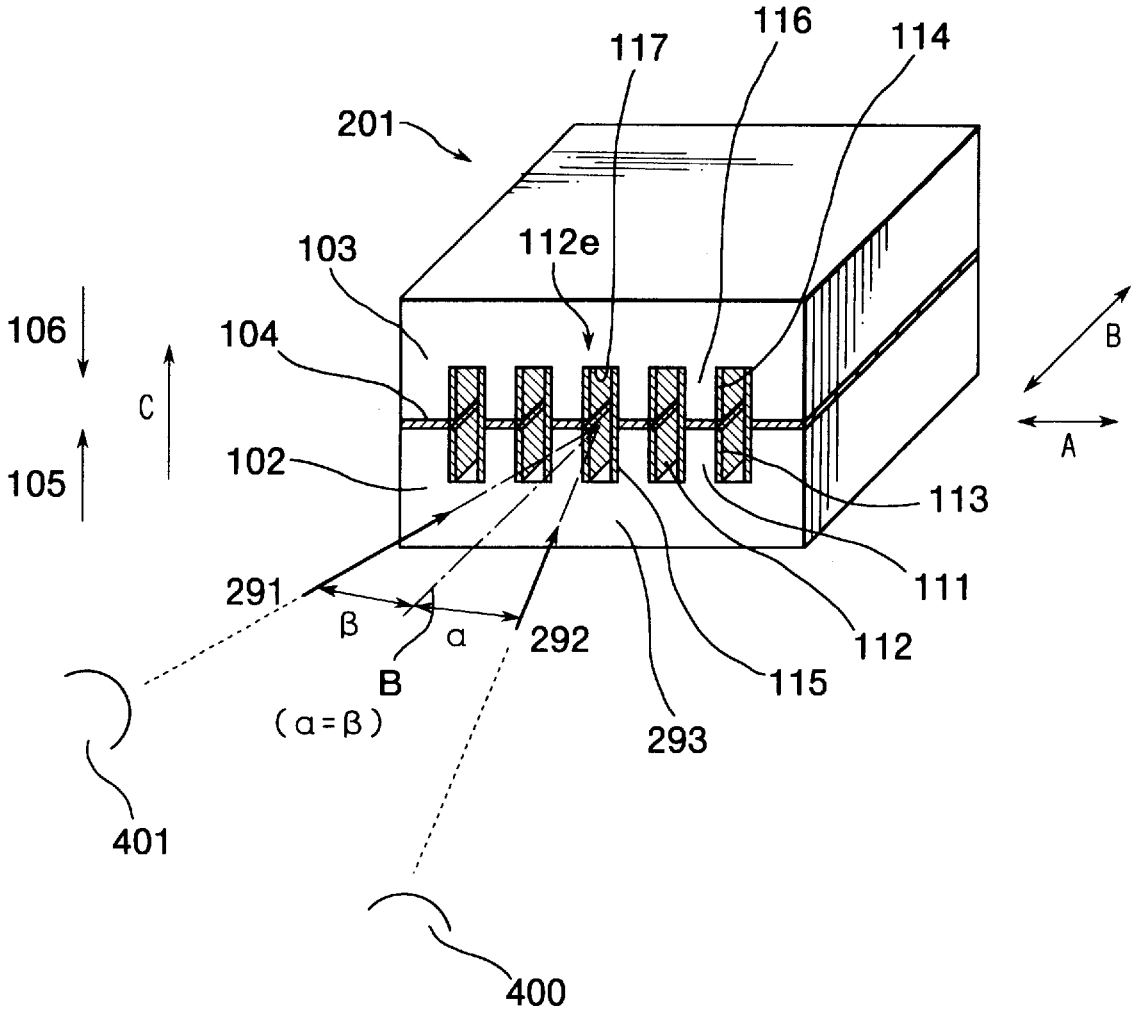
FIG. 13 is a perspective view showing how to form electrodes 213 on the actuator portion of FIG. 12.

First, as shown in FIG. 13, a pair of conductive material sources 400 and 401 are located on the same level of the adhesive layer 104 along the vertical direction C. (Both the polarization directions 105 and 106 extend along the vertical direction C.) The conductive material source 400 is oriented relative to the actuator portion 201 so that conductive material travels from the conductive material source 400 toward a subject ink chamber 112 along a direction 292. The direction 292 is shifted rightwardly by an angle a from the direction B, along which the subject ink chamber 112 extends. The conductive material source 401 is oriented relative to the actuator portion 201 so that conductive material travels from the conductive material source 401 toward the subject ink chamber in another direction 291. The direction 291 is shifted leftwardly by an angle β from the direction B. In this example, the angles α and β are equal to each other, and have a value within a range of 0 to 90 degrees.

The conductive material is ejected or emitted from the sources 400 and 401. The conductive material enters the subject ink chamber 112 through its front open end 112*e*. The conductive material then collides against the areas of the electrodes 113 and 114 near to the front open end 112*e*. The conductive material is deposited on the electrodes. Thus, electrodes 213 are formed over the electrodes 113 and 114 on both inner side surfaces of the subject ink chamber 112.

It is noted that the conductive material also collides against the area of the front end surface 293 around the front open end 112*e*. The conductive material is therefore deposited on the front end surface 293. Thus deposited conductive layer is removed from the front end surface 293 thorough an abrasive machining process.

The conductive material sources 400 and 401 can be designed to perform various deposition processes, such as a vacuum evaporation process, a sputtering process, and a spraying process. The conductive material sources can therefore be designed to emit molecules, molecule clusters, or particles, of conductive material. Examples of the conductive material include: nickel, gold, copper, and carbon.

When the vacuum evaporation is employed, two molten metal sources 400 and 401 are placed in the vacuum atmosphere. Metal gas molecules are radially evaporated from the molten metal, and fly toward the subject ink chamber 112.

When the sputtering process is employed, two pieces of solid metal are placed in a vacuum atmosphere. Ion is accelerated in an electric field to collide against each piece of solid metal, whereupon metal molecules are emitted to fly toward the ink chamber 112.

When the spraying process is employed, molten metal particles are sprayed in the air atmosphere toward the ink chamber 112.

It is noted that when the vacuum evaporation method or the spraying method is employed, the conductive material sources 400 and 401 are preferably oriented to form the angle α in a range of 10° and 80°. When the sputtering method is employed, the sources 400 and 401 are preferably oriented to form the angle α in another range of 0° and 70°. Thus orientating the sources provides proper ranges of thickness and length of the electrodes 213 where the length of electrodes 213 are defined along the direction B.

In the above description, the conductive material sources 400 and 401 are oriented symmetrically with regards to the actuator portion 200. That is, the angles α and β are equal to each other. However, the conductive material sources may be oriented asymmetrically with regards to the actuator portion 201. That is, the angles α and β may be differentiated from each other.

In the above description, two conductive material sources are employed so that conductive material enters the ink chamber from two directions. However, only one conductive material source may be used. That is, the conductive material source 400 is first located as shown in FIG. 13 to eject metal material. Then, the conductive material source 400 is moved toward the position, where the material source 401 is located in FIG. 13, to again eject metal material.

Further, conductive material may be ejected toward the ink chamber in only one direction or in more than two directions. For example, conductive material may be ejected in four directions. Only one conductive material source or more than two conductive material sources may be employed. Additionally, the conductive material sources may not be located on the same level with the adhesive layer 104.

In the above description, conductive material deposited on the front end surface 293 is entirely removed from the front end surface 293. However, the conductive material may be partly remained on the front end surface 293. Thus remained conductive material may be used for electrical connection with the control unit of FIG. 4. For example, the remained conductive material may be used as the electrode patterns 150 which are connected to the conductor patterns 142 on the flexible plate 141 of FIG. 11.

The conductive material may be removed from the front end surface 293 through various methods other than the abrasive machining process. For example, a resist layer may be first formed on the front end surface 293 of the actuator portion 201. Then, the conductive material is ejected toward the ink chambers 112. Afterward, the resist layer is removed from the front end surface 293 through various processes, such as a mechanical peeling process and a chemical dissolution process, so that the conductive layer formed on the front end surface 293 is removed together with the resist layer.

As described above, according to the present invention, an ink jet print head is constructed from first and second actuator plates. Each side wall on the first actuator and a corresponding side wall of the second actuator are connected to each other, at their top surfaces, to form a single side wall. An ink chamber filled with ink is formed between the thus formed two adjacent side walls. The side walls on the first actuator are formed with first electrodes, and the side walls on the second actuator are formed with second electrodes. Additional electrodes are provided over both the first and second electrodes to provide reliable electrical connection therebetween.

While the invention has been described in detail with reference to specific embodiments thereof, it would be apparent to those skilled in the art that various changes and modifications may be made therein without departing from the spirit of the invention.

Figure 14:
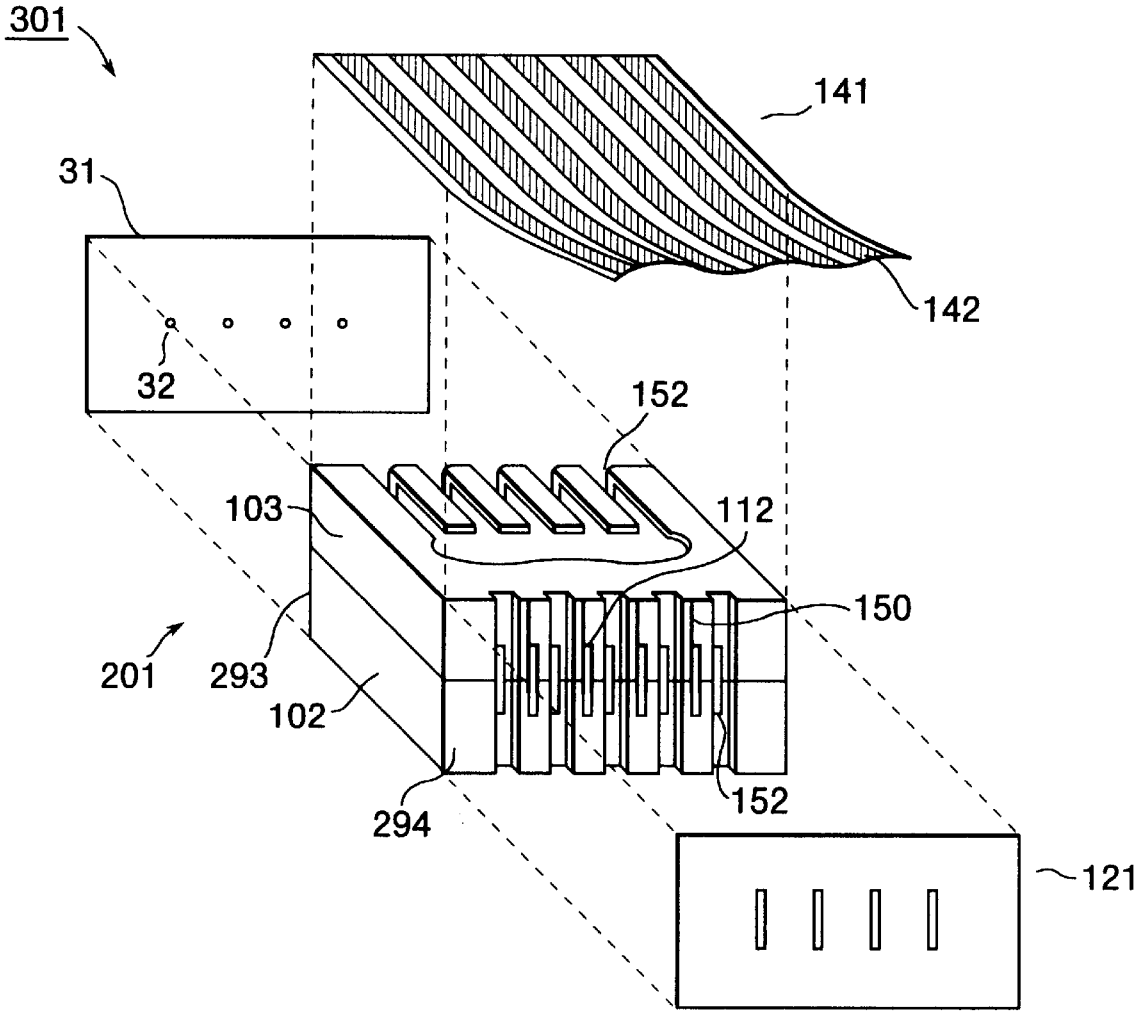
FIG. 14(A) is a perspective view illustrating how the ink jet print head of a modification of the present invention is assembled.
FIG. 14(B) is a perspective view showing a front surface of the actuator portion of the ink jet print head of FIG. 14(A).
Figure 14:
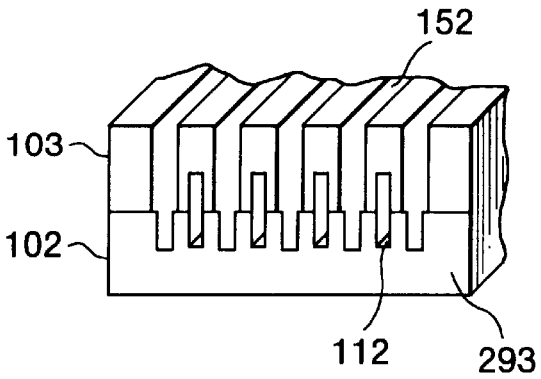

For example, in the above-described embodiments, the ink chambers 112 are adjacent to each other. However, air chambers filled with air may be provided between the ink chambers. In this case, ink droplets can be ejected at the same time from the nozzles connected to all of the ink chambers. FIGS. 14(A) and 14(B) show how to configure the ink jet print head where ink chambers 112 and air chambers 152 are arranged alternately with each other. As apparent from FIGS. 14(A) and 14(B), the air chambers 152 are opened also at the upper surface of the actuator portion 201 at the front end surface 293. The electrodes 213 formed on the inner side surfaces of the air chambers 152 are connected to the conductor patterns 142 via those opened sections.

In the above-described embodiments, the side walls 111 and 116 are each formed from a single piezoelectric material member. That is, the entire actuator plates 102 and 103 are made from piezoelectric material. However, each side wall may be formed from a plurality of piezoelectric material members stacked along the polarization direction. Or, the side wall may be formed from members made of nonpiezoelectric material and piezoelectric material stacked alternately along the polarization direction.

Still further, the ink jet print head of the present invention may have any number of ink chambers, such as 50, 100, or any other number of ink chambers.

I claim:

1. An ink jet print head for ejecting ink droplets, the ink jet print head comprising:

a first actuator plate formed with a plurality of first grooves, each of the plurality of first grooves being defined by an adjacent pair of first side walls, at least a part of each first side wall being made of piezoelectric material, a first electrode being formed on at least a part of side surfaces of each first side wall; and a second actuator plate formed with a plurality of second grooves, each of the plurality of second grooves being defined by an adjacent pair of second side walls, at least a part of each second side wall being made of piezoelectric material, a second electrode being formed on at least a part of side surfaces of each second side wall, the second actuator plate being connected to the first actuator plate so that a top surface of each first side wall is connected to a top surface of a corresponding second side wall, each said first groove being communicated with a corresponding second groove to form an ink chamber; and a third electrode being provided in each said ink chamber over and in contact with at least a part of the first electrode and at least a part of the second electrode to electrically connect the first electrode to the second electrode.

2. An ink jet print head for ejecting ink droplets the ink jet print head comprising:

a first actuator plate formed with a plurality of first grooves, each of the plurality of first grooves being defined by an adjacent pair of first side walls, at least a part of each first side wall being made of piezoelectric material, a first electrode being formed on at least a part of side surfaces of each first side wall; and a second actuator plate formed with a plurality of second grooves, each of the plurality of second grooves being defined by an adjacent pair of second side walls, at least a part of each second side wall being made of piezoelectric material, a second electrode being formed on at least a part of side surfaces of each second side wall, the second actuator plate being connected to the first actuator plate so that a top surface of each first side wall is connected to a top surface of a corresponding second side wall, each said first groove being communicated with a corresponding second groove to form an ink chamber; and a third electrode being provided in each said ink chamber directly over and in contact with at least a part of the first electrode and at least a part of the second electrode to electrically connect the first electrode to the second electrode.

3. An ink jet print head of claim 2, wherein the top surface of each said first side wall is connected to the top surface of the corresponding second side wall by a connection layer of adhesive agent.

4. An ink jet print head of claim 3, wherein each first electrode is provided over an entire side surface of one first side wall and a part of the top surface of the one first side wall, and wherein each second electrode is provided over an entire side surface of one second side wall and a part of the top surface of the one second side wall, the connection layer being provided between the top surface of the one first side wall and the top surface of the one second side wall where the first electrode or the second electrode is not formed.

5. An ink jet print head of claim 3, wherein the adhesive agent constituting the connection layer is added with conductive particles.

6. An ink jet print head of claim 2, wherein the third electrode is formed over the at least a part of the first electrode and the at least a part of the second electrode through a plating method.

7. An ink jet print head of claim 2, wherein the third electrode is formed over the at least a part of the first electrode and the at least a part of the second electrode through a vacuum evaporation method.

8. An ink jet print head of claim 2, wherein the third electrode is formed over the at least a part of the first electrode and the at least a part of the second electrode through a sputtering method.

9. An ink jet print head of claim 2, further comprising a nozzle plate having a plurality of nozzles communicated with the ink chambers.

10. An ink jet print head of claim 2, further comprising an ink introduction portion for supplying ink to the ink chambers.

11. An ink jet print head of claim 2, further comprising a control portion, electrically connected to the third electrodes, for selectively supplying electric voltages so as to develop electric fields through the first side walls and the second side walls.

12. An ink jet print head of claim 2, wherein the third electrode is electrically connected to a power source to supply an equal electric voltage to each of the first electrode and the second electrode, thereby developing a first electric field through the first side wall and a second electric field equal to the first electric field through the second side wall, the first side wall and the second side wall being deformed due to the first electric field and the second electric field to thereby apply pressure in ink filled in the ink chamber.

13. An ink jet print head of claim 12, wherein the first side walls are arranged in a first predetermined direction, each of the first side walls extending along a second predetermined direction perpendicular to the first predetermined direction, the piezoelectric material constituting the at least a part of the first side wall being polarized in a third predetermined direction perpendicular to both the first predetermined direction and the second predetermined direction, the first electrode developing the first electric field through the first side wall in a direction normal to the third predetermined direction thereby causing the first side wall to be deformed, wherein the second side walls are arranged in the first predetermined direction, each of the second side walls extending along the second predetermined direction, the piezoelectric material constituting the at least a part of the second side wall being polarized in a polarizing direction opposite to the third predetermined direction, the second electrode developing the second electric field through the second side wall in a direction normal to the polarizing direction thereby causing the second side wall to be deformed, and wherein the third electrode is provided over at least a part of the first electrode and at least a part of the second electrode.

14. An ink jet print head of claim 2, wherein the third electrode is provided in each said ink chamber to be provided over an entire part of the first electrode and an entire part of the second electrode to electrically connect the first electrode to the second electrode.

* * * * *